US006851932B2

(12) United States Patent
Lagrange et al.

(10) Patent No.: US 6,851,932 B2
(45) Date of Patent: Feb. 8, 2005

(54) VIBRATION DAMPER ASSEMBLY FOR THE BUCKETS OF A TURBINE

(75) Inventors: Benjamin Arnette Lagrange, Simpsonville, SC (US); Kevin Lee Worley, Easley, SC (US); Stephen Paul Wassynger, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 43 days.

(21) Appl. No.: 10/436,202

(22) Filed: May 13, 2003

(65) Prior Publication Data

US 2004/0228731 A1 Nov. 18, 2004

(51) Int. Cl.[7] ..... F01D 5/26
(52) U.S. Cl. ..... 416/190; 416/219 R; 416/500
(58) Field of Search ..... 416/190, 193 A, 416/500, 219 R

(56) References Cited

U.S. PATENT DOCUMENTS 5,156,528 A * 10/1992 Bobo ..... 416/190
5,281,097 A * 1/1994 Wilson et al. ..... 416/193 A
5,478,207 A * 12/1995 Stec ..... 416/219 R
5,827,047 A * 10/1998 Gonsor et al. ..... 416/193 A
6,354,803 B1 * 3/2002 Grover et al. ..... 416/190
6,390,775 B1 * 5/2002 Paz ..... 416/193 A
6,450,769 B2 * 9/2002 Szwedowicz ..... 416/190
6,478,544 B2 * 11/2002 Brandl et al. ..... 416/190
6,776,583 B1 * 8/2004 Wang et al. ..... 416/500

* cited by examiner

*Primary Examiner*—Hoang Nguyen
(74) *Attorney, Agent, or Firm*—Nixon & Vanderhye

(57) ABSTRACT

A damper pin is disposed between adjacent buckets of a turbine rotor. A first bucket has circumferentially extending supports defining a pair of axially spaced surfaces on which a damper pin rests in a cold condition of the turbine. The adjacent bucket is undercut adjacent its platform to provide an angled surface overlying a generally correspondingly angled surface of the damper pin. The damper pin fits slightly loose within the recess and, upon turbine rotation at speed, the angled surfaces of the damper pin and recess cooperate to bias the damper pin against the first bucket whereby the damper pin engages both buckets and dissipates vibratory action.

16 Claims, 4 Drawing Sheets

VIBRATION DAMPER ASSEMBLY FOR THE BUCKETS OF A TURBINE

BACKGROUND OF THE INVENTION

The present invention relates to turbines having circumferentially-spaced buckets about a rotor wheel and particularly relates to a bucket damper assembly including a pin disposed between adjacent buckets for damping bucket vibration.

As well known, turbines generally include a rotor, for example, comprised of a plurality of rotor wheels, each of which mounts a plurality of circumferentially-spaced buckets. The buckets typically include an airfoil, a platform, a shank and a dovetail, the dovetail being received in a slot or opening in the turbine wheel for securing the bucket to the wheel. The airfoils, of course, project into the gas path, e.g., the hot gas path of a gas turbine, and convert kinetic energy of the gases into rotational mechanical energy. During engine operation, vibrations are introduced into the turbine buckets and, if not dissipated, may cause premature failure of the buckets.

Many different forms of vibration dampers have been proposed and constructed to minimize or eliminate vibratory action of the buckets. For example, see U.S. Pat. Nos. 6,354,803; 5,156,528; 6,390,775; 6,478,544; 5,827,047; and 6,450,769. While the vibration dampers disclosed in these patents may be useful to damp vibrations in certain types of turbine, they do not appear to be completely applicable to or effective with respect to buckets having a short shank and shroudless airfoil tips. It is therefore desirable to provide a damper assembly including a pin specifically useful for this type of turbine bucket, although the assembly and pin have applicability to other turbine buckets.

BRIEF DESCRIPTION OF THE INVENTION

It will be appreciated that short shanks on buckets have less platform motion, resulting in less effective damping. The converse is true for shanks of greater length, assuming equal shank width and thickness. Vibratory platform deflection is directly related to shank length relative to the overall bucket length. For buckets in a stage where the ratio of shank length to total length is lower than that of a typical stage 1 bucket ratio, the lower ratio results in a lower magnitude of platform deflection and therefore a lower potential for damper effectiveness. On buckets which have shrouds at their tips, the shrouds afford additional damping, which minimizes the risk of utilizing shorter shanks on shrouded buckets. However, for turbine buckets on stages where the buckets are shroudless and have short shanks, there is increased risk of inadequate damping.

In accordance with the preferred embodiment of the present invention, there is provided an assembly, for example, pairs of adjacent buckets with a damper pin between the buckets, which reduces the amplitude of vibratory stresses at full-speed full-load, full-speed no-load, and transiently, enables increased bucket life and is particularly useful for short shank shroudless buckets. To accomplish the foregoing, and in a preferred embodiment, each bucket is provided with a configuration along its circumferentially opposite sides, i.e., sides corresponding to the pressure and suction sides of the airfoil, enabling the capture of a damper pin between the adjacent buckets. Particularly, a first bucket includes a support, preferably a generally axially spaced pair of supports, projecting in a generally circumferential direction away from the first bucket beyond a marginal edge of the platform and toward the adjacent second bucket. Preferably, the support extends from the suction side of the buckets. The adjacent second bucket includes an undercut extending in a generally axial direction underlying the platform of the second bucket. The undercut of the second bucket, the support surface and a generally radially extending surface along the first bucket define a generally triangular-shaped, substantially axially extending, recess between the pair of buckets underlying the platform of the second bucket. The recess includes an angled surface formed by the second bucket. An elongated damper pin is disposed in the recess, has a generally triangular cross-sectional shape, and fits slightly loose within the recess.

In a cold condition of the turbine, the damper pin generally rests on the support of the first bucket. Upon obtaining full-speed operation, the damper pin is displaced generally radially outwardly. The registering angled surfaces of the damper pin and the second bucket bias the damper pin to engage the radial surface of the first bucket. The damper pin thus engages the radial and angled surfaces of the respective first and second buckets. This frictional engagement permits dissipation of the vibratory motion of both buckets. The contact surfaces of the buckets with the damper pin are also preferably machined to provide improved surface fits therebetween and enhance vibration dissipating performance. The recess also opens outwardly in an axial direction, enabling the damper pin to be visible upon installation. This is important when the turbine is assembled to make sure that all damper pins have been installed. Otherwise, higher vibratory amplitudes causing higher stresses may result, causing the buckets to fail due to high-cycle fatigue. Further, the triangular, more particularly, the generally right triangular configuration of the recess and damper pin in cross-section, provides an anti-rotation feature which facilitates correct placement of the damper pin in service without jamming. The configuration of the recess and damper thus improve wear resistance, increase durability, effectively reduce vibratory stresses and inhibit failure due to high-cycle fatigue.

In a preferred embodiment according to the present invention, there is provided an assembly of buckets for a turbine wheel, comprising a pair of circumferentially adjacent buckets each having a bucket airfoil, a platform, a shank and a dovetail, the dovetails being shaped for securement of the buckets to the turbine wheel, a first bucket of the pair of buckets including at least a first support extending in a generally circumferential direction from a side thereof and beyond a marginal edge of the platform of the first bucket, the support including a support surface, a second bucket of the pair thereof having an undercut opening in a generally circumferential direction toward the first bucket and underlying the platform of the second bucket, the undercut including a surface angled radially outwardly and toward the first bucket, the first bucket including a generally radially extending surface adjacent the support, the radially extending surface and the support surface of the first bucket, together with the angled surface of the undercut of the second bucket, forming a recess between the pair of buckets underlying the second bucket and a damper pin disposed between the adjacent buckets and in the recess, the damper pin being movable within the recess between a first position resting on the support surface and a second position engaging the radially extending surface of the first bucket and the angled surface of the recess of the second bucket for dissipating vibratory motion of the buckets.

In a further preferred embodiment according to the present invention, there is provided an assembly of buckets for a turbine wheel, comprising a pair of circumferentially adjacent buckets each having a bucket airfoil, a platform, a shank and a dovetail, the dovetails being shaped for securement of the buckets to the turbine wheel, a first bucket of the pair of buckets including first and second supports extending in a generally circumferential direction from a side thereof and beyond a marginal edge of the platform of the first bucket, the supports including first and second support surfaces, a second bucket of the pair thereof having an undercut opening in a generally circumferential direction toward the first bucket and underlying the platform of the second bucket, the undercut including a surface angled radially outwardly and toward the first bucket, the first bucket including a contact surface, the contact surface and the support surface of the first bucket, together with the angled surface of the undercut of the second bucket, forming a recess between the pair of buckets underlying the second bucket and a damper pin disposed between the adjacent buckets and in the recess, at least one boss along the damper pin disposed between the supports for preventing displacement of the damper pin in opposite axial directions, the damper pin being movable within the recess between a first position resting on the support surface and a second position engaging the contact surface of the first bucket and the angled surface of the recess of the second bucket for dissipating vibratory motion of the buckets.

DETAILED DESCRIPTION OF THE INVENTION

Figure 1:
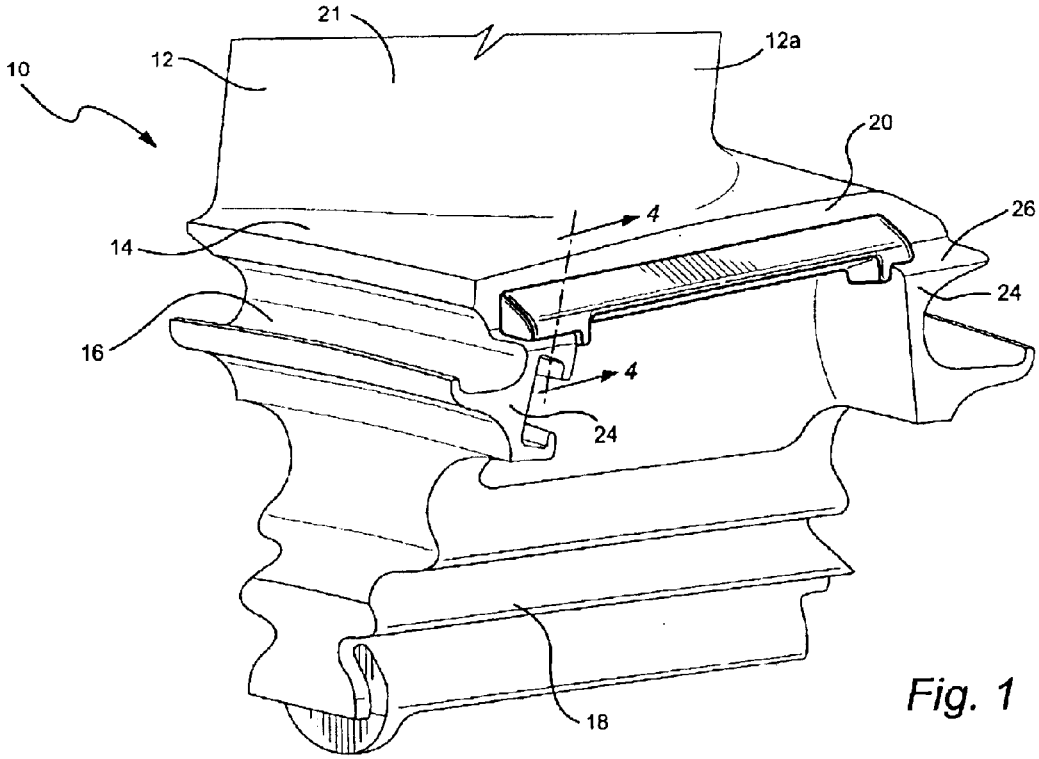
FIG. 1 is a fragmentary perspective view of a portion of a bucket illustrating the bucket in combination with a damper pin according to a preferred embodiment of the present invention.

Referring now to the drawings, particularly to FIG. 1, there is illustrated a bucket, generally designated 10, including a bucket airfoil 12, a platform 14, a shank 16 and a dovetail 18. It will be appreciated that the bucket 10 as illustrated is one of a plurality of circumferentially spaced buckets secured to and about the rotor of a turbine. For example, gas turbines typically have a plurality of rotor wheels having axial or slightly off-axis dovetail-shaped openings for receiving the dovetail 18 of the bucket 10 whereby an annular array of circumferentially spaced buckets, including the airfoils 12, is provided about the rotor. From a review of FIGS. 1 and 2, the opposed and adjacent circumferential edges of each of the bucket platforms form slashfaces 20 and 22. As indicated previously, the airfoils 12 project into the gas stream and enable the kinetic energy of the fluid stream to be converted to mechanical energy through the rotation of the rotor.

Figure 2:
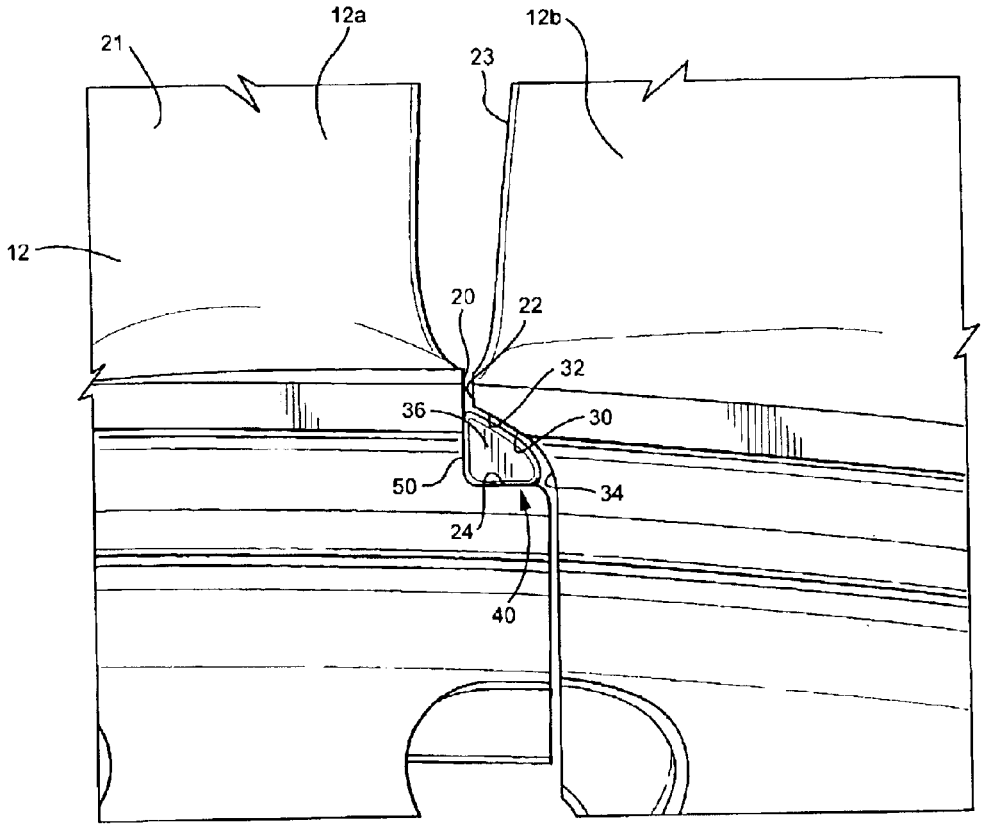
FIG. 2 is a fragmentary, substantially axial view illustrating the damper pin between adjacent buckets.

As illustrated in FIG. 2, the assembly hereof includes circumferentially adjacent first and second buckets 12*a* and 12*b*, respectively. The slashface 20 of the first bucket 12*a* extends along the side face of platform 14 and into the shank 16. The shank 16 on the suction side 21 of the bucket airfoil 12 includes a pair of generally axially spaced supports 24 which project beyond the lateral edge of the slashface 20. Each support 24 includes a generally circumferentially extending shelf or support surface 26 (FIG. 1) adjacent the opposite axial ends of the bucket platform and shank. The region between the supports 24 on the suction side of the bucket 12*a* lies generally open and generally parallel to the slashface 20. Consequently, the supports 24 provide shelves 26 at generally axially opposite ends of the bucket which project in a circumferential direction from the suction side of the bucket toward the adjacent bucket.

As illustrated in FIG. 2, the adjacent or second bucket 12*b* includes an undercut 30 generally below the bucket platform 14 on the pressure side of the bucket 12*b* and which may include portions of the platform 14 and the shank 16 of the second bucket. The undercut 30 is formed along the pressure side of the bucket 12*b*, the trailing edge 23 of which is illustrated in FIG. 2. It will be appreciated that the undercut includes an angled surface 32 which extends the full axial length of the bucket and is angled radially outwardly and toward the adjacent first bucket. The angled surface 32 terminates in a fillet region 34. The undercut 30 of the second bucket forms with the support shelves 26 of the first bucket a pair of recesses 36 adjacent axial ends of the adjoining buckets.

Figure 3:
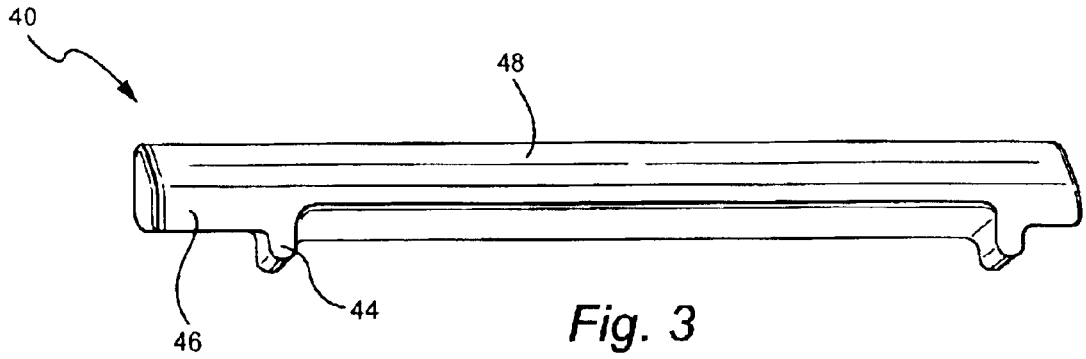
FIG. 3 is a perspective view of a preferred embodiment of damper pin.
Figure 4:
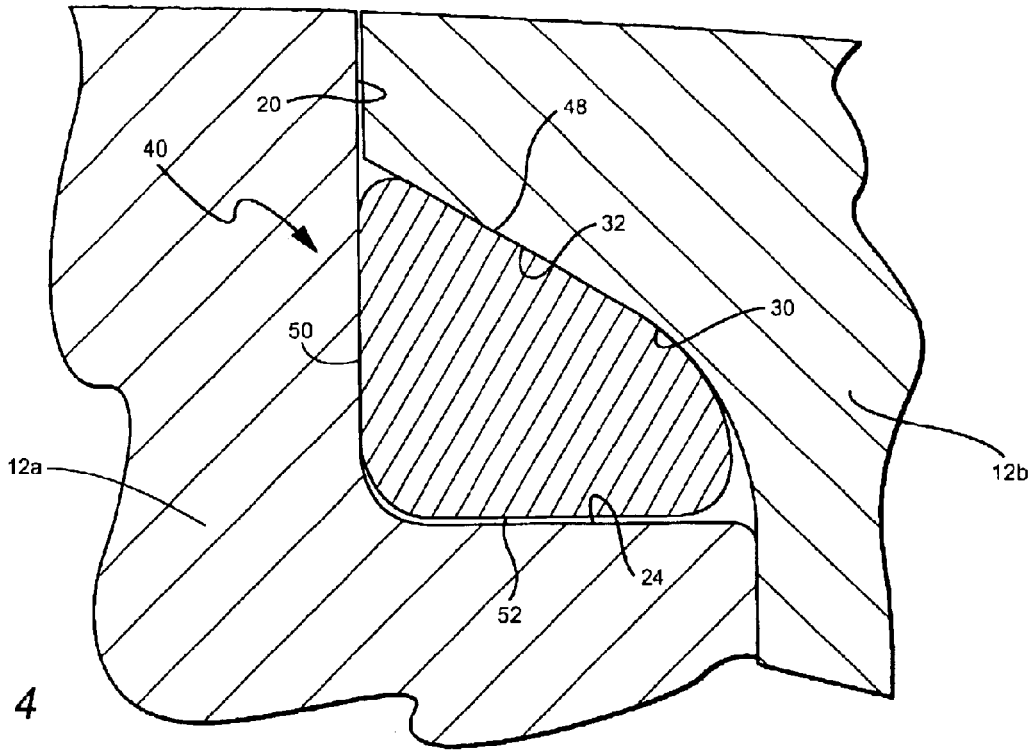
FIG. 4 is an enlarged fragmentary cross-sectional view taken generally about on line 4—4 in FIG. 1 and illustrating the damper pin in the recess between adjacent buckets in an operable position for dissipating vibration.

Referring now to FIG. 3, there is illustrated a damper pin, generally designated 40, for reception in the recess 36 formed between the adjacent buckets. The damper pin 40 includes an elongated, generally triangularly-shaped element in cross-section, as illustrated in FIGS. 2 and 4. A pair of axially spaced bosses 44 are provided along the underside of the damper pin 40. When installed, the bosses 44 project generally radially inwardly and are spaced one from the other a distance less than the distance between the supports 24 of the turbine bucket. The cross-section of the damper pin between the bosses 44 is generally an equilateral triangle, while the end portions 46 of the damper pin 40 axially outwardly of the bosses 44 have a generally right triangular configuration in cross-section with a hypotenuse and bases 50 and 52 lying generally radially and tangentially, respectively, of the triangle.

From a review of FIG. 2, it will be appreciated that the end portions 46 of the damper pin 40 reside in the recesses 36 formed between the undercut 32 on the second bucket and the shelves 26 and generally radial slash surface 20 of the first bucket. The configuration of the ends 46 thus is generally conformal to the configuration of the recesses 36. It will be appreciated, however, that the fit between the end portions 46 and the recesses 36 is slightly loose, permitting generally radial outward movement of the damper pin in the recesses. Additionally, the damper pin 40 may be displaced toward the first bucket upon engagement between the angled surface 32 of the undercut 30 and the surface 48 generally forming the hypotenuse on the damper pin 40. That is, as the rotor obtains full speed and because of the loose fitting engagement between the end portions 46 and the recesses 36, the damper pin 40, upon being displaced radially outwardly by centrifugal force, causes engagement between the surface 48 and angled surface 32 which forces the radial surface 50 of the damper pin into engagement with the slashface 20. Thus, both buckets 12*a* and 12*b* are engaged by the damper pin at full-speed rotation of the rotor.

From a review of FIG. 2, it will be appreciated that the damper pin is exposed, i.e., visible, in an axial direction, from at least one and preferably both axial end faces of the buckets. Consequently, it is possible to visually determine that the damper pin has been installed between adjacent buckets upon assembly of the rotor. It will also be appreciated that the bosses 44 preclude removal of the damper pin 40 in an axial direction from the recesses 36 upon installation. While a pair of bosses 44 are illustrated, it will be appreciated that a single boss extending the distance corresponding to the spacing between the bosses 44 may likewise be used if desired.

Figure 5:
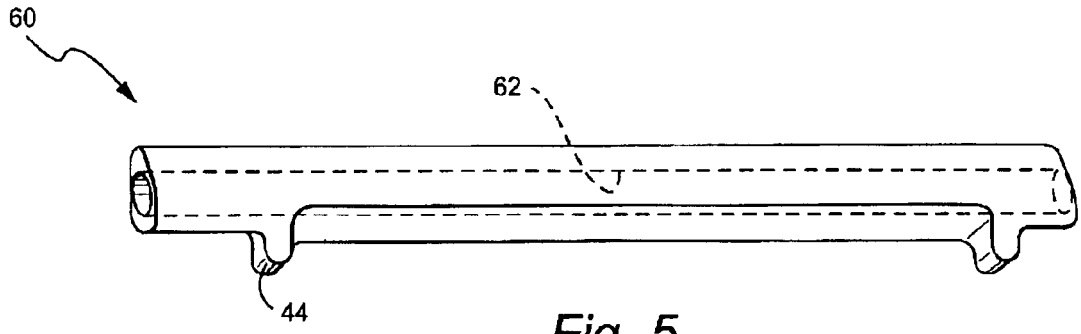
FIG. 5 is a view similar to FIG. 3, illustrating a further form of damper pin hereof.

Referring to FIG. 5, there is illustrated a further form of damper pin, generally designated 60. Damper pin 60 includes an identical external surface configuration as described with respect to damper pin 40. In this form, however, the damper pin 60 may have a hollow core 62, i.e., a passage 64 extending between opposite ends and through the length of the damper pin. A pair of axially aligned passages may be provided with solid portions of the damper pin positioned between the pair of passages intermediate the opposite ends of the damper pin 60.

In operation of the turbine, the damper pin typically rests on the supports 24, particularly on shelves 26, when the turbine is not running. At speed, however, the slightly loose fit between the damper pin in the recesses enables the damper pin ends 46 to lift off the support surfaces 26 so that the surface 48 of the damper pin 40 and the angled surface 32 engage one another due to the centrifugal action on the damper pin. That engagement also biases the damper pin for movement in a circumferential direction such that the base 50 of the damper pin engages the slashface 20. With the damper pin engaging both turbine buckets 12*a* and 12*b* along base 50 and surface 48, the vibration of the buckets is dissipated by the frictional contact between the damper pin and buckets.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An assembly of buckets for a turbine wheel, comprising:

a pair of circumferentially adjacent buckets each having a bucket airfoil, a platform, a shank and a dovetail, the dovetails being shaped for securement of the buckets to the turbine wheel;

a first bucket of said pair of buckets including at least a first support extending in a generally circumferential direction from a side thereof and beyond a marginal edge of the platform of said first bucket, said support including a support surface;

a second bucket of said pair thereof having an undercut opening in a generally circumferential direction toward said first bucket and underlying the platform of said second bucket, said undercut including a surface angled radially outwardly and toward said first bucket, said first bucket including a generally radially extending surface adjacent said support, said radially extending surface and said support surface of said first bucket, together with the angled surface of said undercut of said second bucket, forming a recess between said pair of buckets underlying said second bucket; and a damper pin disposed between said adjacent buckets and in said recess, said damper pin being movable within said recess between a first position resting on said support surface and a second position engaging said radially extending surface of said first bucket and said angled surface of the recess of said second bucket for dissipating vibratory motion of the buckets.

2. An assembly according to claim 1 wherein said damper pin and said recess are sized to enable a third surface of the damper pin to lift off said support surface in response to rotation of the turbine wheel.

3. An assembly according to claim 1 including a second support on said first bucket generally axially spaced from said first support and having a second support surface for supporting the damper pin, at least one boss along the damper pin being disposed between said supports for preventing displacement of said damper pin in at least one axial direction.

4. An assembly according to claim 1 including a second support generally axially spaced from said first support on said first bucket and having a second support surface for supporting said damper pin, and a pair of bosses along said damper pin disposed between said support surfaces for preventing displacement of said damper pin in opposite axial directions.

5. An assembly according to claim 1 wherein said recess opens along common axial faces of said buckets, exposing an end of the damper pin for viewing from an axial direction and externally of the buckets and wheel.

6. An assembly according to claim 1 wherein said damper pin and said recess are generally triangularly-shaped and have respective registering surfaces configured relative to one another to preclude rotation of the damper pin about an axis thereof generally parallel to an axis of rotation of the turbine wheel.

7. An assembly according to claim 1 wherein the surfaces of said first and second buckets defining said recess are machined surfaces.

8. An assembly according to claim 1 wherein said recess along said second bucket lies on the side of said bucket corresponding to a pressure surface of the bucket airfoil.

9. An assembly according to claim 1 wherein said support projects from a side of said first bucket corresponding to a suction side of the airfoil of said first bucket.

10. An assembly of buckets for a turbine wheel, comprising:

a pair of circumferentially adjacent buckets each having a bucket airfoil, a platform, a shank and a dovetail, the dovetails being shaped for securement of the buckets to the turbine wheel;

a first bucket of said pair of buckets including first and second supports extending in a generally circumferential direction from a side thereof and beyond a marginal edge of the platform of said first bucket, said supports including first and second support surfaces;

a second bucket of said pair thereof having an undercut opening in a generally circumferential direction toward said first bucket and underlying the platform of said second bucket, said undercut including a surface angled radially outwardly and toward said first bucket, said first bucket including a contact surface, said contact surface and said support surface of said first bucket, together with the angled surface of said undercut of said second bucket, forming a recess between said pair of buckets underlying said second bucket; and a damper pin disposed between said adjacent buckets and in said recess, at least one boss along the damper pin disposed between said supports for preventing displacement of said damper pin in opposite axial directions, said damper pin being movable within said recess between a first position resting on said support surface and a second position engaging said contact surface of said first bucket and said angled surface of the recess of said second bucket for dissipating vibratory motion of the buckets.

11. An assembly according to claim 10 wherein said damper pin and said recess are sized to enable a third surface of the damper pin to lift off said support surfaces in response to rotation of the turbine wheel.

12. An assembly according to claim 10 wherein said recess opens along common axial faces of said buckets, exposing an end of the damper pin for viewing from an axial direction and externally of the buckets and wheel.

13. An assembly according to claim 10 wherein said damper pin and said recess are generally triangularly-shaped and have respective registering surfaces configured relative to one another to preclude rotation of the damper pin about an axis thereof generally parallel to an axis of rotation of the turbine wheel.

14. An assembly according to claim 10 wherein the surfaces of said first and second buckets defining said recess are machined surfaces.

15. An assembly according to claim 9 wherein said recess along said second bucket lies on the side of said bucket corresponding to a pressure surface of the bucket airfoil.

16. An assembly according to claim 9 wherein said support projects from a side of said first bucket corresponding to a suction side of the airfoil of said first bucket.

* * * * *